US009416982B2

(12) United States Patent
Kim et al.

(10) Patent No.: US 9,416,982 B2
(45) Date of Patent: Aug. 16, 2016

(54) OUTDOOR UNIT FOR AIR CONDITIONER

(75) Inventors: Jung Hoon Kim, Seoul (KR); Jeong Taek Park, Seoul (KR); Yong Sang Yoon, Seoul (KR); Choon Myun Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 428 days.

(21) Appl. No.: 13/147,158

(22) PCT Filed: Mar. 12, 2010

(86) PCT No.: PCT/KR2010/001570

§ 371 (c)(1),
(2), (4) Date: Aug. 23, 2011

(87) PCT Pub. No.: WO2010/104360

PCT Pub. Date: Sep. 16, 2010

(65) Prior Publication Data

US 2011/0312264 A1 Dec. 22, 2011

(30) Foreign Application Priority Data

Mar. 12, 2009 (KR) ..... 10-2009-0021007

(51) Int. Cl.

| | |
|---|---|
| ***F24F 7/007*** | (2006.01) |
| ***F24F 1/38*** | (2011.01) |
| ***F24F 1/40*** | (2011.01) |
| ***F24F 1/50*** | (2011.01) |

(Continued)

(52) U.S. Cl.

CPC ... *F24F 1/38* (2013.01); *F24F 1/40* (2013.01); *F24F 1/50* (2013.01); *F24F 13/20* (2013.01); *F24F 13/24* (2013.01)

(58) Field of Classification Search

CPC ..... F24F 1/48; F24F 1/50; F24F 1/54; F24F 1/06; F24F 1/08; F24F 1/14; F24F 1/38; F24F 1/40; F24F 13/20; F24F 13/24; G05G 9/085; H02K 9/06

USPC ..... 415/98–100; 454/184, 241, 244, 388, 454/338; 416/128, 198 R

See application file for complete search history.

(56) References Cited

U.S. PATENT DOCUMENTS

| | | | | |
|---|---|---|---|---|
| 2,391,859 A | | 1/1946 | Babcock | |
| 2,582,848 A | * | 1/1952 | Price | 244/59 |
| 2,987,984 A | * | 6/1961 | Miller | 454/202 |

(Continued)

FOREIGN PATENT DOCUMENTS

| | | |
|---|---|---|
| JP | 2004-271107 | 9/2004 |
| JP | 2004-271107 A | 9/2004 |

(Continued)

*Primary Examiner* — Gregory Huson
*Assistant Examiner* — Dana Tighe
(74) *Attorney, Agent, or Firm* — Dentons US LLP

(57) ABSTRACT

An outdoor unit for an air conditioner is disclosed, the outdoor unit characterized by: a case (100) formed with an air suction port (110) sucking air from outside and an air discharge port (120) discharging the sucked air; a first blowing fan (200) formed inside the case (100) for dis¬charging the air sucked from the air suction port (110) to the air discharge port (120); and a second blowing fan (300) formed inside the case (100) and positioned on the same axis of the first blowing fan (200) for rotating in an opposite direction of the first blowing fan (200), such that generation of cavitation of a blowing fan is limited to greatly reduce noise and vibration.

2 Claims, 3 Drawing Sheets

(51) Int. Cl.
*F24F 13/20* (2006.01)
*F24F 13/24* (2006.01)

(56) References Cited

U.S. PATENT DOCUMENTS

| | | | | |
|---|---|---|---|---|
| 3,083,312 | A * | 3/1963 | Moore | 310/157 |
| 3,083,893 | A * | 4/1963 | Dean | 417/247 |
| 3,337,122 | A * | 8/1967 | Gross | 416/125 |
| 3,827,483 | A * | 8/1974 | Hopkinson | 165/145 |
| 4,124,166 | A * | 11/1978 | Lucas | 239/662 |
| 4,164,852 | A * | 8/1979 | Anzalone | 62/429 |
| 4,321,803 | A * | 3/1982 | Smith | 62/507 |
| 4,521,153 | A * | 6/1985 | Morimoto et al. | 415/146 |
| 5,049,769 | A * | 9/1991 | Reinhardt et al. | 310/64 |
| 5,258,676 | A * | 11/1993 | Reinhardt et al. | 310/112 |
| 5,404,939 | A * | 4/1995 | Lim et al. | 165/122 |
| 5,675,206 | A * | 10/1997 | Horski | 310/268 |
| 5,775,119 | A * | 7/1998 | Yamada et al. | 62/259.1 |
| 5,814,908 | A * | 9/1998 | Muszynski | 310/62 |
| 6,107,708 | A * | 8/2000 | Yamaguchi et al. | 310/58 |
| 6,220,906 | B1 * | 4/2001 | Dubois | B63H 5/10 114/20.1 |
| 6,565,334 | B1 * | 5/2003 | Bradbury et al. | 417/423.1 |
| 6,591,873 | B1 * | 7/2003 | McNeil | 141/4 |
| 6,960,059 | B2 * | 11/2005 | Chang et al. | 415/65 |
| 7,137,263 | B2 * | 11/2006 | Collins et al. | 62/180 |
| 7,156,611 | B2 * | 1/2007 | Oosawa et al. | 415/68 |
| 7,618,233 | B2 * | 11/2009 | Parker et al. | 415/119 |
| 7,630,198 | B2 * | 12/2009 | Doll | 361/679.49 |
| 7,828,510 | B2 * | 11/2010 | Chang et al. | 415/61 |
| 7,909,568 | B2 * | 3/2011 | Ishihara et al. | 415/61 |
| 8,074,461 | B2 * | 12/2011 | McKenna | 62/183 |
| 8,137,059 | B2 * | 3/2012 | Kim et al. | 415/121.2 |
| 8,172,501 | B2 * | 5/2012 | Nishizawa et al. | 415/68 |
| 2003/0021674 | A1 * | 1/2003 | Zeighami et al. | 415/119 |
| 2003/0194313 | A1 * | 10/2003 | Lin et al. | 415/198.1 |
| 2005/0110366 | A1 * | 5/2005 | Chang et al. | 310/268 |
| 2005/0249598 | A1 * | 11/2005 | Young | 416/198 R |
| 2008/0042502 | A1 * | 2/2008 | VanLuik et al. | 310/89 |
| 2009/0110542 | A1 * | 4/2009 | Kim et al. | 415/121.2 |
| 2009/0257872 | A1 * | 10/2009 | June et al. | 416/1 |
| 2010/0011803 | A1 * | 1/2010 | Warnecker et al. | 62/498 |
| 2010/0033041 | A1 * | 2/2010 | Watanabe et al. | 310/63 |
| 2010/0260616 | A1 * | 10/2010 | Osawa et al. | 417/53 |
| 2011/0163087 | A1 * | 7/2011 | Wakashima et al. | 219/630 |
| 2011/0174011 | A1 * | 7/2011 | Kim et al. | 62/426 |
| 2011/0185763 | A1 * | 8/2011 | Wakashima et al. | 62/434 |
| 2012/0212086 | A1 * | 8/2012 | Nagayama et al. | 310/59 |

FOREIGN PATENT DOCUMENTS

| | | | |
|---|---|---|---|
| JP | 2007-263085 | | 10/2007 |
| JP | 2008-267201 | | 11/2008 |
| KR | 1019980047342 | A | 9/1998 |
| KR | 1019990010487 | A | 2/1999 |
| KR | 20-0150828 | | 7/1999 |
| KR | 20-0150828 | Y1 | 7/1999 |
| WO | WO 2007/148645 | A1 | 12/2007 |
| WO | WO 2008/133240 | A1 | 11/2008 |

* cited by examiner

OUTDOOR UNIT FOR AIR CONDITIONER

This Application is a 35 U.S.C. §371 National Stage Entry of International Application No. PCT/KR2010/001570, filed on Mar. 12, 2010, which claims the benefit of priority to Korean Patent Application No: 10-2009-0021007, filed on Mar. 12, 2009, both of which are hereby incorporated by reference in their entirety for all purposes as if fully set forth herein.

TECHNICAL FIELD

The present invention relates to an outdoor unit for air conditioner configured to limit generation of cavitation of a blowing fan, and to greatly reduce noise and vibration.

BACKGROUND ART

In general, an air conditioner is an apparatus configured to condition air using a refrigerating cycle. As illustrated in FIG. 1, the air conditioner is provided with a refrigerating cycle constituted with a compressor (11) compressing a refrigerant to a high temperature high pressure gaseous refrigerant, an outdoor unit (10) including an outdoor heat exchanger (12) for condensing the compressor-passed refrigerant to a high temperature high pressure liquid refrigerant, an expander (21) reducing the outdoor heat exchanger-passed refrigerant to a low pressure low temperature liquid refrigerant, and an indoor unit (20) including an indoor heat exchanger (22) evaporating the expander-passed refrigerant to a low temperature low pressure gaseous refrigerant and absorbing an indoor heat to maintain a room at a low temperature.

The air conditioner is divided into a window type air conditioner and a separated (or split) type air conditioner according to an installation method of an outdoor unit (10) and an indoor unit (20). Although the window type air conditioner and the split type air conditioner are functionally same, but may be different according to installation method.

That is, the window type air conditioner is installed at the window, etc. under the state that an outdoor unit (10) and an indoor unit (20) are integrally assembled to each other in one case, and the separate type air conditioner is respectively installed at the outdoor and the indoor under the state that the outdoor unit and the indoor unit are separated from each other.

As shown in FIG. 2, the typical outdoor unit (10) includes a case (13) formed with an air suction port (13*a*) sucking air from outside and an air discharge port (13*b*) discharging the sucked air, a blowing fan (14) formed inside the case (13) for discharging the air sucked from the air suction port (13*a*) to the air discharge port (13*b*), and a driving motor (15) rotating the blowing fan (14). That is, in a case the blowing fan (14) is rotated by the driving motor (15), the air sucked from the air suction port (13*a*) is heat-exchanged via the outdoor heat exchanger (12) and discharged to the air discharge port (13*b*) via the blowing fan (14).

However, the typical outdoor unit (10) has limitations in that it is formed with a single blowing fan (14) and a diameter of the blowing fan (14) must be enlarged to increase a air volume, or a rotating speed of the driving motor (15) must be increased. As a result, the conventional outdoor unit (10) suffers from disadvantages in that a cavitation is generated at the blowing fan (14), a load is increased to easily destruct the blowing fan (14) and noise and vibration are seriously generated.

DISCLOSURE OF INVENTION

Technical Problem

The present invention is disclosed to obviate the above-mentioned problems, and it is an object to provide an outdoor unit for an air conditioner configured to limit the generation of cavitation at a blowing fan, and to reduce the diameter of the blowing fan.

It is another object of the present invention to provide an outdoor unit for an air conditioner configured to reduce a load of a blowing fan, thereby improving a life cycle, and to greatly reduce noise and vibration.

The above-disclosed subject matters are to be considered illustrative, and not restrictive. Other particular subject matters may be appreciated and practiced in different but equivalent manners apparent to those skilled in the art having the benefit of the teachings herein.

Solution to Problem

In one general aspect of the present invention, there is provided an outdoor unit for an air conditioner, characterized by: a case (100) formed with an air suction port (110) sucking air from outside and an air discharge port (120) discharging the sucked air; a first blowing fan (200) formed inside the case (100) for discharging the air sucked from the air suction port (110) to the air discharge port (120); and a second blowing fan (300) formed inside the case (100) and positioned on the same axis of the first blowing fan (200) for rotating in an opposite direction of the first blowing fan (200).

In some exemplary embodiments, the outdoor unit may further include a first driving motor rotating the first blowing fan and a second driving motor rotating the second blowing fan.

In some exemplary embodiments, the first and second driving motors may be fixed inside the case by a motor mount.

In some exemplary embodiments, the motor mount fan may be formed in one single unit for simultaneously fixing the first and second driving motors.

In some exemplary embodiments, the first blowing fan may be formed perpendicularly to the suction port, and the second blowing fan may be formed in opposite to the discharge port.

In some exemplary embodiments, the outdoor unit may further include a driving motor driving the first blowing fan and the second blowing fan, and a power transfer unit for transmitting a driving power of the driving motor to the first and second blowing fans may be formed between the first and second blowing fans.

In some exemplary embodiments, the power transfer unit may include a driving bevel gear fixed at a rotation shaft of the driving motor, a first driven bevel gear fixed at the first blowing fan for being meshed with the driving bevel gear, and a second driven bevel gear fixed at the second blowing fan and formed in opposition to the first driven bevel gear for being meshed with the driving bevel gear.

Advantageous Effects of Invention

The outdoor unit for an air conditioner according to the present invention is advantageous in that a first blowing fan and a second blowing fan are arranged on the same axle but rotated in opposite direction to limit the generation of cavitation from the blowing fans, and to reduce the diameter of the blowing fans. Another advantage is that the load of the blowing fans can be reduced to improve the life cycle of the air conditioner and to greatly reduce noise and vibration. Still another advantage is that the first blowing fan and the second blowing fan can be driven by one single driving motor to thereby reduce the manufacturing cost.

BEST MODE FOR CARRYING OUT THE INVENTION

Figure 1:
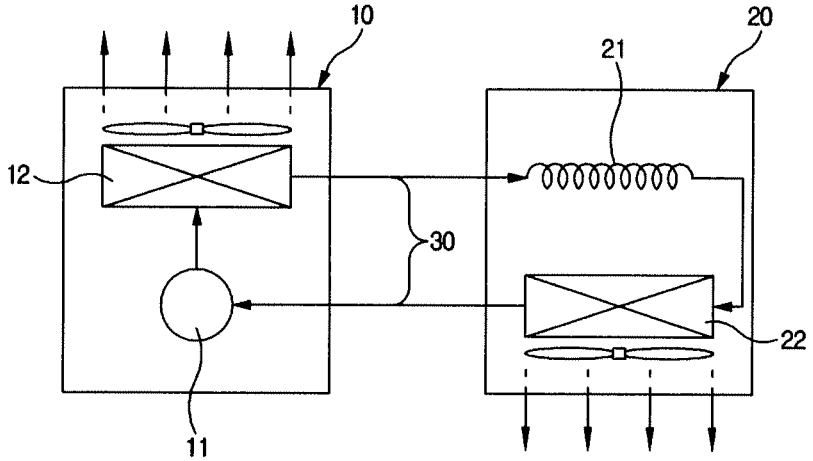
FIG. 1 is a schematic view illustrating a refrigerating cycle of a typical air conditioner.
Figure 2:
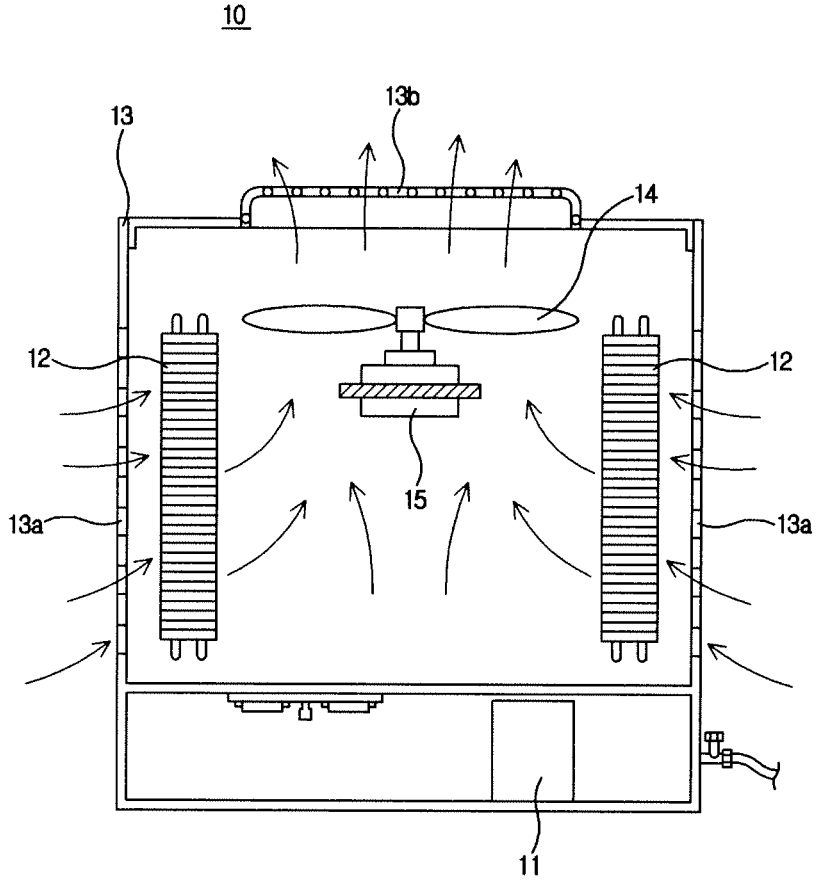
FIG. 2 is a schematic view illustrating an outdoor unit for a typical air conditioner.

Exemplary embodiments of the present invention will be described in detail with reference to the accompanying drawings.

In describing the present disclosure, detailed descriptions of constructions or processes known in the art may be omitted to avoid obscuring appreciation of the invention by a person of ordinary skill in the art with unnecessary detail regarding such known constructions and functions. Accordingly, the meaning of specific terms or words used in the specification and claims should not be limited to the literal or commonly employed sense, but should be construed or may be different in accordance with the intention of a user or an operator and customary usages. Therefore, the definition of the specific terms or words should be based on the contents across the specification. In the drawings, the sizes and relevant shapes of constituent elements may be exaggerated for clarity and convenience sake.

Figure 3:
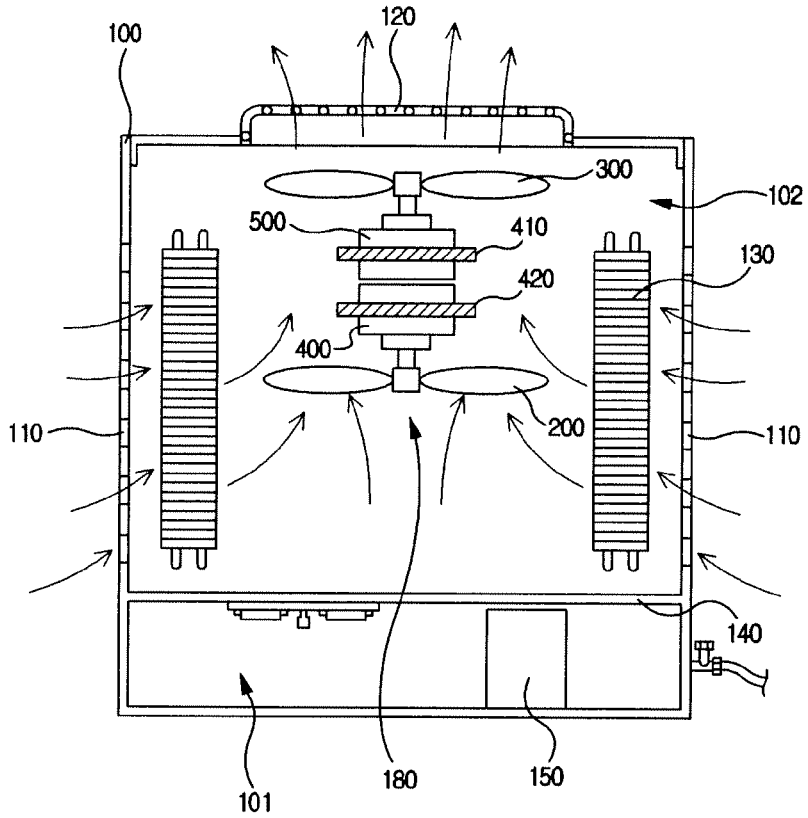
FIG. 3 is a schematic view illustrating an outdoor unit for an air conditioner according to a first exemplary embodiment of the present invention.

FIG. 3 is a schematic view illustrating an outdoor unit for an air conditioner according to a first exemplary embodiment of the present invention.

An outdoor unit for air conditioner according to a first exemplary embodiment of the present invention include a case (100), a blowing apparatus (180) and an outdoor heat exchanger (130). The case (100) is formed with a suction port (110) for sucking an outside air, and a discharge port (120) for discharging the outdoor heat exchanger-passed and heat-exchanged air to the outside.

For example, the suction port (110) is formed at a lateral surface of the case (100), and the discharge port (120) is formed at an upper surface of the case (100). One or more suction ports (110) and discharge ports (120) may be formed and may be disposed at any surface of the case (front, rear, left, right, upper or lower surface of the case) according to shape and installed position of the outdoor heat exchanger (130).

The case (100) is disposed therein with a machine room (101) and a heat exchange room (102) partitioned by a barrier (140), where the machine room (101) is formed with various parts such as compressor (150) and a circuit board, and the heat exchange room (102) is formed with the outdoor heat exchanger (130) and a blowing fan assembly (180).

The blowing fan assembly (180) includes a first blowing fan (200), a second blowing fan (300) arranged on the same axis as that of the first blowing fan (200), and driving motors (400, 500) driving the first and second blowing fans (200, 300). The first blowing fan (200) and the second blowing fan (300) are formed on the same axis but each fan is rotating in opposite direction.

The first blowing fan (200) is arranged perpendicularly to the suction port (110) and sucks the outside air to the inside through the suction port (110). The second blowing fan (300) is oppositely arranged from the discharge port (120) to discharge the air sucked into the case (100) to the outside.

The first and second blowing fans (200, 300) are axial fans, and are rotatively fixed inside the case (100), and are positioned in opposition to the discharge port (120) of the case (100). Therefore, the air is sucked from the suction port (110) by the rotation of the first and second blowing fans (200, 300) to be discharged to the discharge port (120) through the first and second blowing fans (200, 300).

The first and second blowing fans (200, 300) are disposed on the same axis but rotated in the opposite direction, where component force in the tangential direction of the air discharged through the first blowing fan (2000 is offset by the second blowing fan (300), and simultaneously the resultant force in the axial direction of the discharged air is reinforced to increase the discharged air volume.

The increased in the discharged air volume may increase the heat exchange efficiency of the outdoor heat exchanger (130). At this time, the discharged air volume can be increased by the first and second blowing fans (200, 300), and the component force in the tangential direction is offset to prevent the generation of cavitation, to prolong the life by reducing the load and to reduce the noise and the vibration to the maximum.

The driving motor includes a first driving motor (400) rotating the first blowing fan (200), and a second driving motor (500) rotating the second blowing fan (300). At this time, motor mounts (410, 420) may be needed to fix the first and second driving motors (400, 500) inside the case (100).

In case the motor mounts (410, 420) are separately manufactured, a distance between the first and second driving motors (400, 500) is lengthened, such that the motor mount may be manufactured in an integral single type in order to compactly arrange the first and second driving motors (400, 500).

Figure 4:
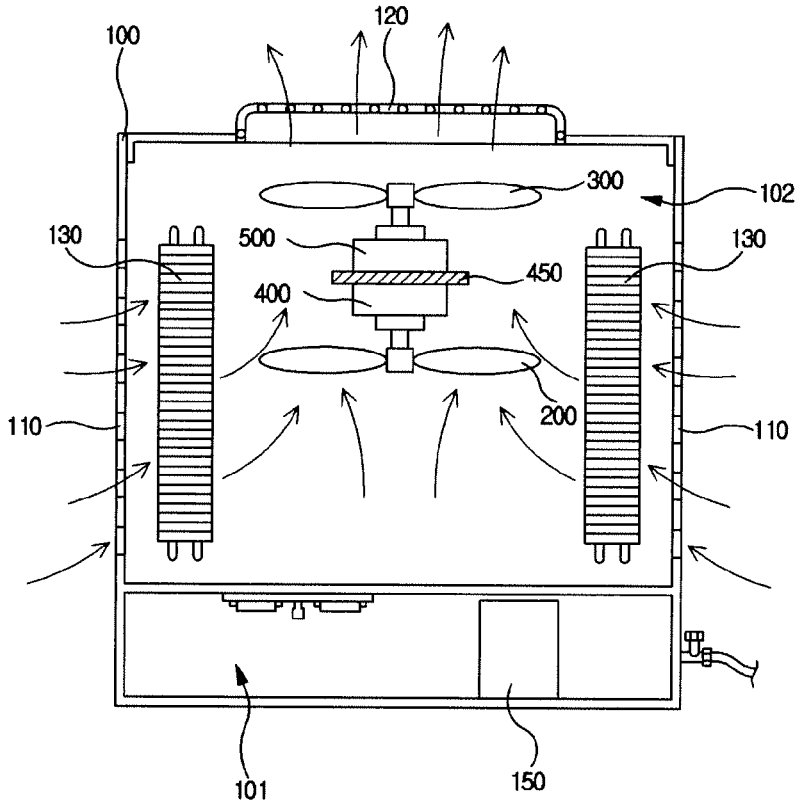
FIG. 4 is a schematic view illustrating an outdoor unit for an air conditioner according to a second exemplary embodiment of the present invention.

That is, as shown in FIG. 4, a single motor mount (450) may be fixedly formed at both sides thereof with the first and second driving motors (400, 500). As a result, the vibration and noise can be offset because the first driving motor (400) and the second driving motor (500) are rotating in the opposite direction and use of space can be also maximized.

MODE FOR THE INVENTION

Figure 5:
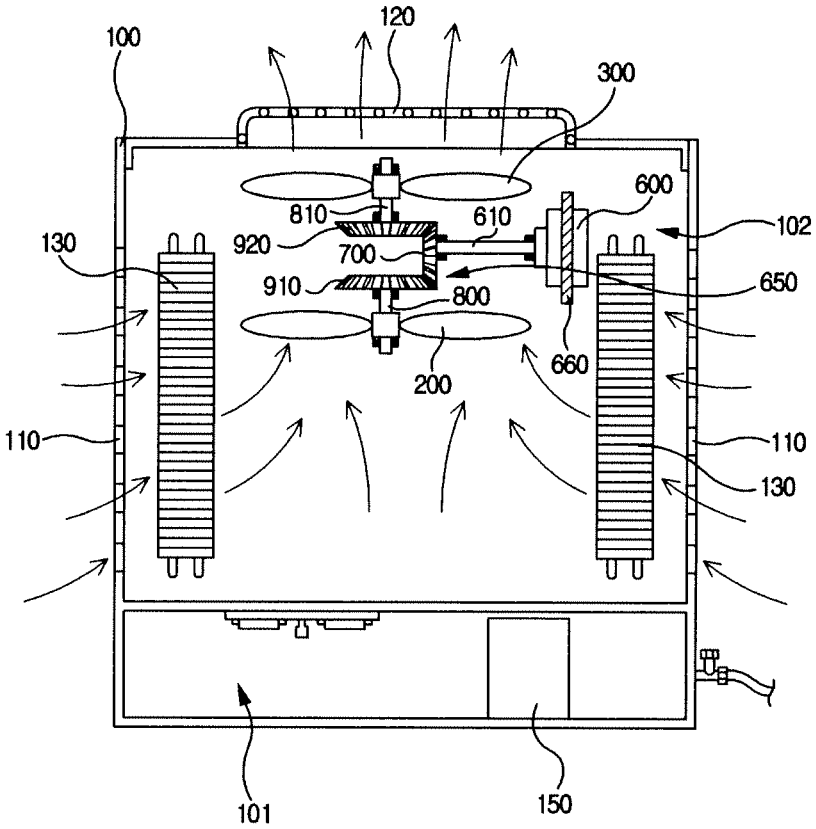
FIG. 5 is a schematic view illustrating an outdoor unit for an air conditioner according to a third exemplary embodiment of the present invention.

FIG. 5 is a schematic view illustrating an outdoor unit for an air conditioner according to a third exemplary embodiment of the present invention.

An outdoor unit according to the third exemplary embodiment of the present invention includes a first blowing fan (200), a second blowing fan (300) arrange on the same axis as that of the first blowing fan (200), a single driving motor (600) for driving the first and second blowing fans (200, 300), and a power transfer unit (650) transmitting the rotation force of the driving motor (600) to the first and second blowing fans (200, 300).

The configuration and operation of the first and second blowing fans (200, 300) are the same as those of the above-mentioned exemplary embodiment, such that further explanation thereto is omitted.

One single driving motor (600) drives both the first and second blowing fans (200, 300) and is fixed at the case (100) by a motor mount (660).

Figure 6:
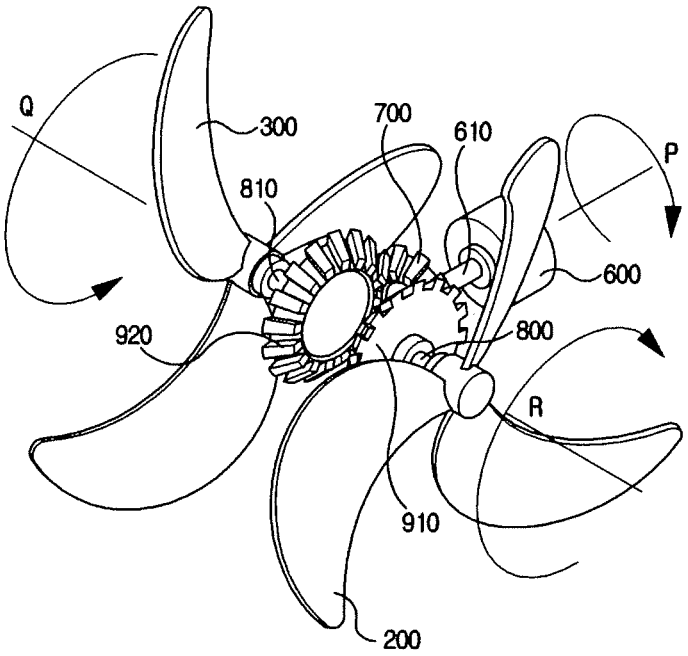
FIG. 6 is a perspective view illustrating a power transfer unit according to a third exemplary embodiment of the present invention.

As shown in FIG. 6, the power transfer unit (650) serves to transmit the rotation force of the driving motor (600) to the first and second blowing fans (200, 300) and to rotate the first and second blowing fans (200, 300) in opposite direction.

An example of the power transfer unit (650) may be a bevel gear. That is, the bevel gear may include a driving bevel gear (700) fixed at a rotation axis (610) of the driving motor (600), a first driven bevel gear (910) fixed at a rotation axis (800) of the first blowing fan (200), and a second driven bevel gear (920) fixed at a rotation axis of the second blowing fan (300) by being meshed with the driving bevel gear (700).

At this time, the first and second driven bevel gears (910, 920) are oppositely arranged and meshed at a right angle to the driving bevel gear (700), such that, in a case the rotation axis (610) of the driving motor (600) is rotated in the P direction, the first driven bevel gear (910) is rotated in the Q direction, and the second driven bevel gear (920) is rotated in the R direction.

Therefore, the first and second driven bevel gears (910, 920) are rotated in opposite direction, whereby the first and second blowing fans (200, 300) are in turn rotated in the opposite direction.

The outdoor unit according to the third exemplary embodiment of the present invention can reduce the manufacturing cost but increase the efficiency by using one single driving motor (600) and driving two blowing fans (200, 300).

While the present disclosure has been particularly shown and described with reference to exemplary embodiments thereof, the general inventive concept is not limited to the above-described embodiments. It will be understood by those of ordinary skill in the art that various changes and variations in form and details may be made therein without departing from the spirit and scope of the present invention as defined by the following claims.

INDUSTRIAL APPLICABILITY

The outdoor unit for an air conditioner according to the present invention has an industrial applicability in that a first blowing fan and a second blowing fan are arranged on the same axis but rotated in opposite direction to limit the generation of cavitation from the blowing fans, and to reduce the diameter of the blowing fans. Another applicability is that the load of the blowing fans can be reduced to improve the life cycle of the air conditioner and to greatly reduce noise and vibration. Still another applicability is that the first blowing fan and the second blowing fan can be driven by one single driving motor to thereby reduce the manufacturing cost.

The invention claimed is:

1. An outdoor unit for an air conditioner, comprising:

a case formed with an air suction port sucking air from outside and an air discharge port discharging the sucked air;

a first blowing fan disposed within the case for discharging the air sucked from the air suction port to the air discharge port;

a second blowing fan disposed within the case and positioned on the same axis of the first blowing fan for rotating in an opposite direction of the first blowing fan;

a driving motor driving the first blowing fan and the second blowing fan; and a power transfer unit for transmitting a driving power of the driving motor to the first and second blowing fans, wherein the power transfer unit is disposed between the first and second blowing fans, wherein the power transfer unit includes a driving bevel gear fixed at a rotation shaft of the driving motor, a first driven bevel gear coupled to the first blowing fan for being meshed with the driving bevel gear, and a second driven bevel gear coupled to the second blowing fan and disposed in opposition to the first driven bevel gear for being meshed with the driving bevel gear, wherein the rotation shaft is disposed perpendicularly to an axis of the first blowing fan and an axis of the second blowing fan, wherein the air suction port is formed on a sidewall of the case, and the air discharge port is formed on a top surface of the case, and wherein the first blowing fan is disposed perpendicularly to the air suction port, and the second blowing fan is facing the air discharge port.

2. The outdoor unit of claim 1, wherein the case is disposed therein with a machine room and a heat exchange room partitioned by a barrier, wherein a compressor is disposed within the machine room, and a heat exchanger is disposed within the heat exchange room, and wherein the compressor is disposed at a location that is separated from a moving route of the air passing the case.

* * * * *